United States Patent [19]

Dussourd et al.

[11] Patent Number: 5,060,759

[45] Date of Patent: Oct. 29, 1991

[54] COMPRESSOR OIL SUPPLY SYSTEM

[75] Inventors: Jules L. Dussourd, Princeton, N.J.; Stanley M. Miller, Rockford, Ill.

[73] Assignee: Sundstrand Corporation, Rockford, Ill.

[21] Appl. No.: 508,578

[22] Filed: Apr. 13, 1990

[51] Int. Cl.[5] ..... F01M 3/00

[52] U.S. Cl. ..... 184/6.2; 184/6.16; 417/68; 418/88; 418/94

[58] Field of Search ..... 184/6.2, 6.16; 417/68, 417/366; 418/88, 94

[56] References Cited

U.S. PATENT DOCUMENTS

| | | | |
|---|---|---|---|
| 3,877,853 | 4/1975 | Harlin | 184/6.16 |
| 3,932,063 | 1/1976 | Butler | 417/68 |
| 4,391,573 | 7/1983 | Tanaka et al. | 418/88 |
| 4,610,602 | 9/1986 | Schmid et al. | 417/68 |
| 4,626,176 | 12/1986 | Cole | 417/54 |
| 4,712,986 | 12/1987 | Nissen | 418/94 |
| 4,729,728 | 3/1988 | Gromoll et al. | 418/88 |
| 4,756,672 | 7/1988 | Trimborn | 417/68 |
| 4,781,542 | 11/1988 | Ozu et al. | 184/6.16 |

FOREIGN PATENT DOCUMENTS

| | | | |
|---|---|---|---|
| 3730685 | 7/1988 | Fed. Rep. of Germany | 418/94 |

*Primary Examiner*—Ira S. Lazarus
*Assistant Examiner*—Alan B. Cariaso
*Attorney, Agent, or Firm*—Wood, Phillips, Mason, Recktenwald & VanSanten

[57] ABSTRACT

In order to continuously supply lubricant to compressor bearings independent of attitude, and under varying gravitational forces, an oil supply system (10) includes an oil sump (14), a pump (22), and a suction tube (24). The oil sump (14) is defined at least in part by a pair of intersecting sump walls (16, 18) each of which may comprise a primary wall dependent upon instantaneous compressor attitude. The pump (22) is adapted to supply the compressor with oil (20) while at the same time removing gases from the oil (20) and expelling the removed gases into the oil sump (14). Additionally, the suction tube extends from the pump to a strategic point within the oil sump (14) for drawing oil (20) from the oil sump (14) to the pump (22) in a manner assisting in priming and repriming during brief interruptions in the flow of oil (20) from the oil sump (14).

13 Claims, 2 Drawing Sheets

COMPRESSOR OIL SUPPLY SYSTEM

FIELD OF THE INVENTION

The present invention relates generally to oil supply systems and, more particularly, an oil supply system for a compressor capable of operating at different attitudes relative to the prevailing gravity field.

BACKGROUND OF THE INVENTION

In many applications such as airborne units, it is necessary for compressors to operate at different attitudes, i.e., vertically, horizontally or even upside down in relation to the prevailing gravity field. The flexibility of the compressor in these applications is usually limited by the operation of the associated lubrication system which requires an oil reservoir designed appropriately to provide a continuous supply of lubricant to the compressor bearings. When the supply of lubricant is interrupted as by flight maneuvers, it is important that it be restarted very rapidly in order to avoid mechanical damage.

One approach of the prior art has been to hermetically encapsulate the compressor, using a horizontally disposed hollow crank shaft of the type that is disclosed in U.S. Pat. No. 4,729,728. The source of power for oil pumping in this case is derived from a jet pump energized by a gaseous discharge stream from the compressor which is caused to expand in a jet nozzle thereby creating a suction which draws oil up through a suction tube and pumps the mixture through the hollow shaft. With this arrangement, centrifugal forces due to shaft rotation will provide some degree of separation such that the oil will move radially outward to feed the bearings and the gas will be discharged into the canister around the compressor housing.

Unfortunately, the arrangement disclosed in U.S. Pat. No. 4,729,728 will work best near the design operating point. On the other hand, it will be mismatched at other points and during start-up. Additionally, it will also back pressure the compressor under such conditions.

Still further, U.S. Pat. No. 4,729,728 teaches the use of a swiveling and rotatable suction tube. This tube is inherently designed to move in accordance with gravitational forces so as to follow the movement of oil in the reservoir. While of interest, this would not be suitable for airborne applications wherein weight is a factor.

Specifically, the swiveling and rotatable suction tube must, by definition, be designed in a manner to cause a weight penalty. This follows from the fact that a very light suction tube may well not be able to overcome frictional forces at the pivot point. For this reason, it has remained to provide an entirely satisfactory oil supply system for a compressor capable of operation at different attitudes.

The present invention is directed to overcoming one or more of the foregoing problems and achieving one or more of the resulting objects.

SUMMARY OF THE INVENTION

It is a principal object of the present invention to provide a new and improved oil supply system for lubricating a compressor. It is a further object of the present invention to provide an oil supply system for a compressor capable of operation at different installation attitudes. It is still another object of the present invention to provide an oil supply system that is suitable for airborne compressor applications.

In an exemplary embodiment, the oil supply system includes an oil sump defined at least in part by a pair of intersecting sump walls each of which may comprise a primary wall dependent upon instantaneous compressor attitude. The oil supply system also includes a pump for supplying the compressor with oil while removing gases from oil and expelling removed gases into the oil sump in a manner wherein the pump assists in priming and repriming during brief interruptions in the flow of oil from the oil sump. With this arrangement, a tube is provided which extends from the pump to a strategic point within the oil sump for delivering oil to the pump over a range of instantaneous compressor attitudes.

Preferably, the oil sump is generally L-shaped in axial cross-section and the sump walls include a generally cylindrical side wall and a generally skewed dome-shaped end wall. The primary wall in an instantaneous horizontal compressor attitude is then the cylindrical side wall and in an instantaneous vertical compressor attitude is the generally skewed dome-shaped end wall. When so configured, the strategic point within the oil sump to which the oil suction tube extends is adjacent a point of intersection of the side wall and the end wall.

In one form of the invention, the pump has a convoluted intake in communication with the oil sump whereby the oil suction tube is adapted to draw oil from the oil sump to the convoluted intake. The convoluted intake may include a first portion generally radially of the pump, a second portion generally parallel to the axis of the pump, and a third portion, again, generally radially of the pump whereby, independent of the instantaneous compressor attitude, at least some portion or portions of the intake will always retain oil for the purpose of priming and repriming the pump. With this arrangement, a liquid ring pump may be utilized which includes a generally cylindrical pump housing and an impeller assembly mounted for relative eccentric rotation within the housing.

In this form of the invention, the oil suction tube will extend from the oil sump to what amounts to a separate, convoluted intake of the pump, i.e., the oil suction tube and the convoluted intake are separate components defining a single, continuous flow path. Alternatively, the oil suction tube may simply comprise a single elongated tube which feeds directly into the pump in which case it will have at least a first portion extending generally parallel to the generally skewed dome-shaped end wall of the oil sump and a second portion extending generally parallel to the cylindrical side wall of the oil sump. When configured as a single elongated tube, the oil suction tube will also have a reverse bend portion adjacent the pump which extends generally parallel to the generally skewed dome-shaped end wall and generally parallel to the first portion of the oil suction tube.

In a highly preferred embodiment, the liquid ring pump is operable with its oil suction tube in a manner defining means for rapidly priming and repriming the pump during brief interruptions in the flow of oil from the oil sump. The liquid ring pump advantageously has an inlet port in communication with the oil sump, an outlet port in communication with the compressor, and a gas vent port in communication with the oil sump whereby the inlet port and the gas vent port are radially inwardly of the pump housing and the outlet port is in the pump housing radially outwardly of the inlet port and the gas vent port. With this arrangement, the inlet port and the gas vent port each comprise circumferentially spaced generally kidney-shaped openings in an end wall of the pump housing and the outlet port comprises an opening in a side wall of the pump housing.

Still additionally, the impeller assembly preferably includes a central cylindrical hub adapted to rotate eccentrically within the pump housing and having a plurality of impeller blades projecting radially therefrom. The impeller hub thus rotates about its own axis but the liquid surface forms a circular path concentric with the pump housing having a radius encompassing the inlet port and the gas vent port. In this connection, the central hub is dimensioned so as to fully expose the inlet port and the gas vent port within the pump housing.

Other objects, advantages and features of the present invention will become apparent from a consideration of the following specification taken in conjunction with the accompanying drawings.

DETAILED DESCRIPTION OF THE PREFERRED EMBODIMENT

Figure 1:
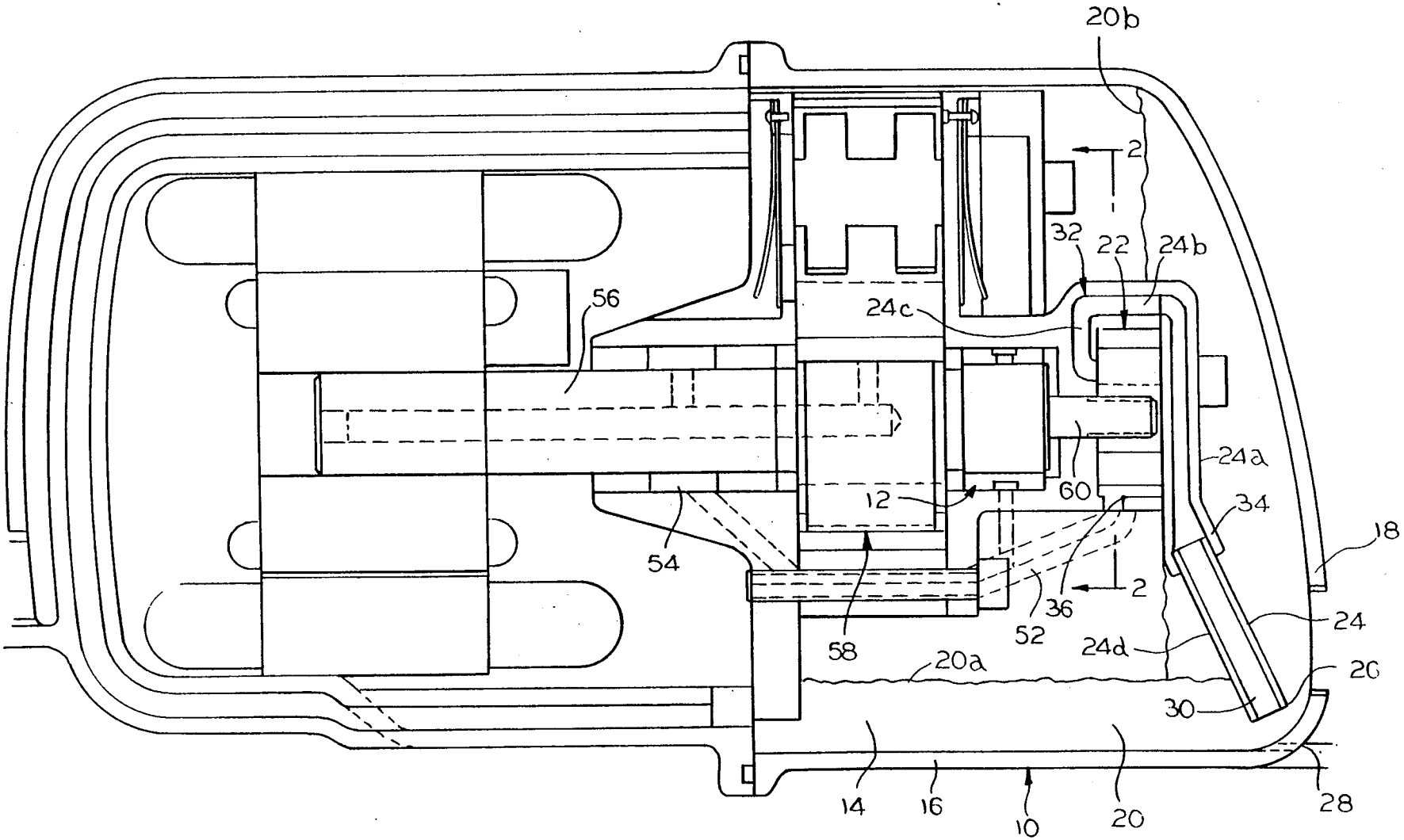
FIG. 1 is a cross-sectional view of a compressor arrangement having an oil supply system in accordance with the present invention.

In the illustration given, and with reference first to FIG. 1, the reference numeral 10 designates generally an oil supply system for a compressor 12 capable of operating at different attitudes. The oil supply system 10 includes an oil sump 14 defined at least in part by a pair of intersecting sump walls 16 and 18 each of which may comprise a primary wall dependent upon instantaneous compressor attitude. The oil supply system 10 also includes means for supplying the compressor with oil 20 such as a pump 22. The oil supply system 10 further includes a tube 24 extending from the pump 22 to a strategic point as at 26 within the oil sump 14 for delivering oil from the oil sump 14 to the pump 22. As will be appreciated from FIG. 1, the strategic point as at 26 to which the oil suction tube 24 extends is adjacent a point of intersection as at 28 of the sump walls 16 and 18, respectively.

Still referring to FIG. 1, the oil sump 14 is generally L-shaped in axial cross-section and the sump walls include a generally cylindrical side wall 16 and a generally skewed dome-shaped end wall 18. It will also be appreciated from FIG. 1 that the primary wall in an instantaneous horizontal compressor attitude (as shown) is the cylindrical side wall 16 in which case the oil 20 will have a surface as at **20*a*, and in an instantaneous vertical compressor attitude (not shown), the primary wall is the generally skewed dome-shaped end wall 18 in which case the oil 20 will have a surface 20*b*. By reason of the location of the strategic point as at 26 to which the oil suction tube 24 extends, the open end 30 of the tube 24** will be submerged in both a vertical and horizontal attitude.

Moreover, it will be appreciated that the open end 30 of the oil suction tube 24 will actually be submerged in a wide variety of attitudes. This, of course, includes attitudes in addition to the horizontal attitude illustrated and the vertical attitude suggested by the surface **20*b* of the oil 20. In this connection, it is important for the dome-shaped end wall 18 to be skewed, as illustrated, because otherwise the low point of the dome would be on the center line of the compressor 12**.

Still referring to FIG. 1, the oil suction tube 24 has at least a first portion **24*a* extending generally parallel to the generally skewed dome-shaped end wall 18 and a second portion 24*b* extending generally parallel to the cylindrical side wall 16. It will also be seen that the oil suction tube 24 has a reverse bend portion 24*c* adjacent the pump 22 which extends generally parallel to the generally skewed dome-shaped end wall and generally parallel to the first portion 24*a* of the oil suction tube 24. In this manner, it will be appreciated that the pump 22 is in communication with the oil sump 14, drawing oil 20 from the oil sump 14 through the oil suction tube 24 for lubricating the compressor 12**.

In the embodiment illustrated, the first, second and reverse bend portions **24*a*–24*c* define a convoluted intake generally designated 32 for the pump 22. The convoluted intake 32 serves to assist in rapidly priming and repriming the pump 22 during brief interruptions in the flow of oil 20 from the oil sump 14 and where there is a composite tubular structure, as shown, rather than a single elongated tube, the oil suction tube may be thought of as comprising a short tube segment 24*d* extending from the convoluted intake 32, i.e., from the end 34 remote from the pump 22. With this arrangement, the short tube segment 24*d* is adapted to draw oil from the oil sump 14 to the convoluted intake 32 of the pump 22**.

Preferably, the pump 22 is a liquid ring pump capable together with the convoluted intake 32 to define means for rapidly priming and repriming during brief interruptions in the flow of oil 20 from the oil sump 14. The liquid ring pump 22 has an inlet port 34 in communication with the oil sump 14, an outlet port 36 in communication with the compressor 12, and a gas vent port 38 in communication with the oil sump 14. In addition, the liquid ring pump 22 includes a generally cylindrical pump housing 40 and an impeller assembly generally designated 42 which is mounted eccentrically within the pump housing 40.

Figure 2:
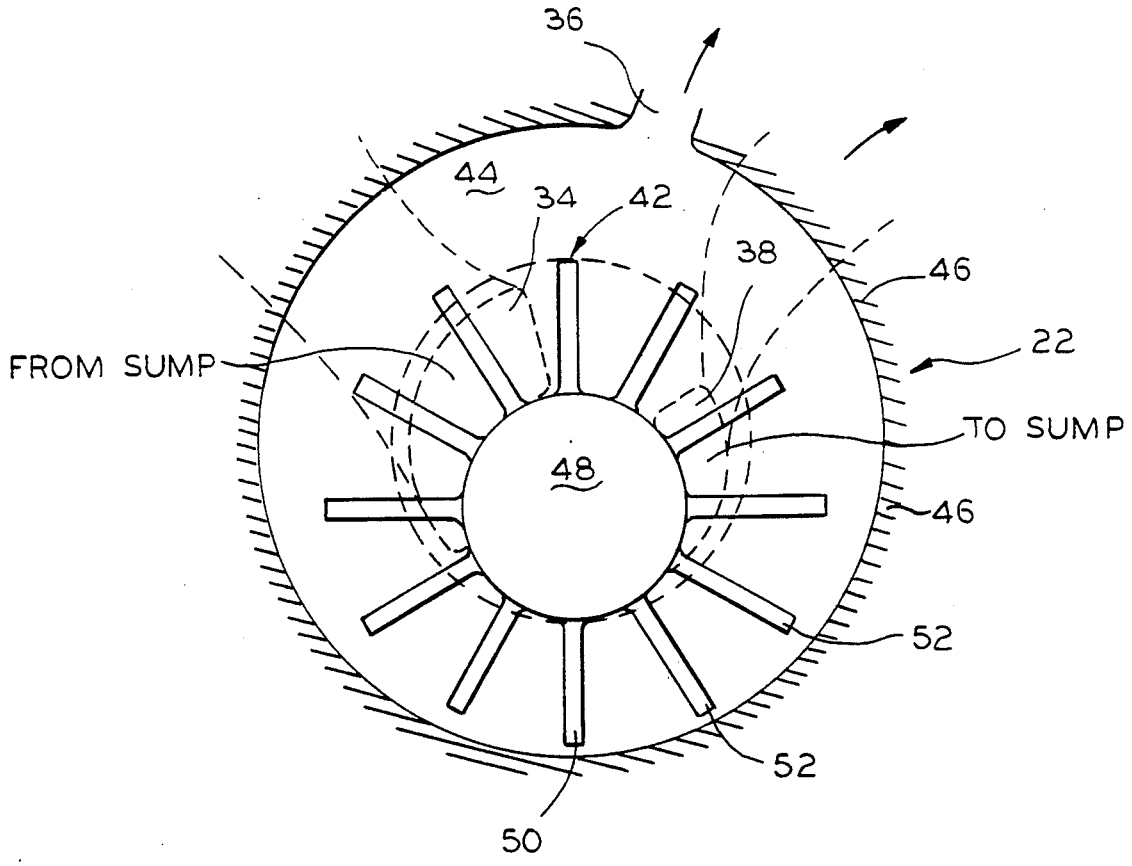
FIG. 2 is a cross-sectional view of the oil supply system taken on the line 2—2 of FIG. 1.

Still referring to FIG. 2, the inlet port 34 and the gas vent port 38 are radially inwardly of the pump housing 40 and the outlet port 36 is in the pump housing 40 radially outwardly of the inlet port 34 and the gas vent port 38. The gas vent port 38, in cooperation with the action of the impeller assembly 42 as it eccentrically rotates within the pump housing 40, comprises means for removing gases from the oil 20 within the pump 22 and expelling the removed gases back into the oil sump 14. As shown, the inlet port 34 and the gas vent port 38 each comprise circumferentially spaced generally kidney-shaped openings in an end wall 44 of the pump housing 40 and the outlet port 36 comprises an opening in a side wall 46 of the pump housing 40.

As best shown in FIG. 2, the impeller assembly 42 includes a central cylindrical hub 48 adapted to rotate eccentrically within the pump housing 40 and having a plurality of impeller blades 50 projecting radially therefrom. The central hub 48 rotates about its own axis but the liquid surface forms a circular path concentric with the housing (as shown in phantom lines) having a radius encompassing the inlet port 34 and the gas vent port 38. Moreover, the central hub 48 is dimensioned so as to fully expose the inlet port 34 and the gas vent port 38 within the pump housing 40.

Referring once again to FIG. 1, the outlet port 36 is adapted to deliver oil from the liquid ring pump 22 through a tube 52 to bearings shown as at 54. These bearings as at 54 are for a shaft 56 of the rotary compressor 12 which, for purposes of illustration only, has been shown as a freon compressor particularly suited for airborne applications. Specifically, the freon compressor 12 is of a type for refrigeration systems which provide cooling for an aircraft, i.e., by means of a rolling piston type compressor.

Still referring to FIG. 1, the compressor 12 is illustrated as being carried on the shaft 56 between the liquid ring pump 22 and a motor 58. The motor 58 drives the shaft 56 which, in turn, drives the compressor 12 and the pump 22 which is shown on a shaft extension 60. As will be appreciated, the details of the compressor 12 and motor 58 are unimportant to an understanding of the present invention.

In this connection, the oil supply system 10 is well suited for any compressor capable of operating at different attitudes. Thus, the details which have been discussed, as well as the other components which have not been discussed for purposes of clarity and brevity, are merely representative of one use of the present invention. As a result, the discussion herein, with the exception of the details of the oil supply system 10, is for illustration purposes only.

While in the foregoing there has been set forth a preferred embodiment of the invention, it will be appreciated that the details herein given may be varied by those skilled in the art without departing from the true spirit and scope of the appended claims.

We claim:

1. An oil supply system for a compressor capable of operating under different attitudes relative to the gravity field, comprising:

an oil sump defined at least in part by a pair of intersecting sump walls, each of said sump walls comprising a primary wall dependent upon instantaneous compressor attitude;

means for supplying said compressor with oil; and an oil suction tube for drawing oil from said oil sump to said oil supplying means, said oil suction tube extending from said oil supplying means to a strategic point said oil sump;

said oil sump being generally L-shaped in axial cross-section and said sump walls including a generally cylindrical side wall and a generally skewed end wall, said strategic point within said oil sump to which said oil suction tube extends being adjacent a point of intersection of said cylindrical side wall and said generally skewed end wall.

2. The oil supply system of claim 1 wherein said primary wall in an instantaneous horizontal compressor attitude is said cylindrical side wall and in an instantaneous vertical compressor attitude is said generally skewed end wall.

3. The oil supply system of claim 1 wherein said oil supplying means comprises a pump in communication with said oil sump, said pump including means for rapidly priming and repriming during brief interruptions in flow of oil from said oil sump.

4. An oil supply system for a compressor capable of operating under different attitudes relative to the gravity field, comprising:

an oil sump defined at least in part by a pair of intersecting sump walls, each of said sump walls comprising a primary wall dependent upon instantaneous compressor attitude;

means for supplying said compressor with oil; and an oil suction tube for drawing oil from said oil sump to said oil supplying means, said oil suction tube extending from said oil supplying means to a strategic point within said oil sump;

said oil sump being generally L-shaped in axial cross-section and said sump walls including a generally cylindrical side wall and a generally skewed end wall, said strategic point within said oil sump to which said oil suction tube extends being adjacent a point of intersection of said cylindrical side wall and said generally skewed end wall;

said oil suction tube having at least a first portion extending generally parallel to said generally skewed end wall and a second portion extending generally parallel to said cylindrical side wall, said oil suction tube having a reverse bend portion adjacent said oil supplying means extending generally parallel to said generally skewed end wall and said first portion of said oil suction tube.

5. An oil supply system for a compressor capable of operating under different attitudes relative to the gravity field, comprising:

an oil sump defined at least in part by a pair of intersecting sump walls, each of said sump walls comprising a primary wall dependent upon instantaneous compressor attitude;

pump means having a convoluted intake in communication with said oil sump for supplying said compressor with oil and assisting in priming and repriming during brief interruptions in flow of oil from said oil sump; and an oil suction tube for drawing oil from said oil sump to said convoluted intake of said pump means, said oil suction tube extending to a strategic point within said oil sump;

said oil sump being generally L-shaped in axial cross-section and said sump walls including a generally cylindrical side wall and a generally skewed dome-shaped end wall, said strategic point within said oil sump to which said oil suction tube extends being adjacent a point of intersection of said cylindrical side wall and said generally skewed dome-shaped end wall;

said pump means comprising a liquid ring pump operable with said convoluted intake to define means for rapidly priming and repriming during brief interruption in flow of oil from said oil sump.

6. The oil supply system of claim 5 wherein said liquid ring pump has an inlet port in communication with said oil sump, an outlet port in communication with said compressor, and a gas vent port in communication with said oil sump.

7. The oil supply system of claim 6 wherein said liquid ring pump includes a generally cylindrical pump housing and an impeller assembly, said impeller assembly being eccentrically mounted within said pump housing for rotation therewithin.

8. The oil supply system of claim 7 wherein said inlet port and said gas vent port are radially inwardly of said pump housing and said outlet port is in said pump housing radially outwardly of said inlet port and said gas vent port.

9. The oil supply system of 7 wherein said convoluted intake includes a first portion generally radially of said pump housing, a second portion generally parallel to said pump housing and a third portion generally radially of said pump housing.

10. An oil supply system for a compressor capable of operating under different attitudes relative to the gravity field, comprising:

an oil sump defined at least in part by a pair of intersecting sump walls, each of said sump walls comprising a primary wall dependent upon instantaneous compressor attitude;

a pump including means for removing gases from oil and expelling removed gases into said oil sump; and an oil suction tube for drawing oil from said oil sump to said pump, said oil suction tube extending to a strategic point within said oil sump;

said oil sump being generally L-shaped in axial cross-section and said sump walls including a generally cylindrical side wall and a generally skewed dome-shaped end wall, said strategic point within said oil sump to which said oil suction tube extends being adjacent a point of intersection of said cylindrical side wall and said generally skewed dome-shaped end wall;

said primary wall in an instantaneous horizontal compressor attitude is a cylindrical side wall and in an instantaneous vertical compressor attitude being a generally skewed dome-shaped end wall, said oil suction tube having at least a first portion extending generally parallel to said generally skewed dome-shaped end wall and a second portion extending generally parallel to said cylindrical side wall, said oil suction tube having a reverse bend portion adjacent said pump extending generally parallel to said generally skewed dome-shaped end wall and said first portion of said oil suction tube.

11. An oil supply system for a compressor capable of operating under different attitudes relative to the gravity field, comprising:

an oil sump defined at least in part by a pair of intersecting sump walls, each of said sump walls comprising a primary wall dependent upon instantaneous compressor attitude;

a pump including means for removing gases from oil and expelling removed gases into said oil sump; and an oil suction tube for drawing oil from said oil sump to said pump, said oil suction tube extending to a strategic point within said oil sump;

said oil sump being generally L-shaped in axial cross-section and said sump walls including a generally cylindrical side wall and a generally skewed dome-shaped end wall, said strategic point within said oil sump to which said oil suction tube extends being adjacent a point of intersection of said cylindrical side wall and said generally skewed dome-shaped end wall;

said pump comprising a liquid ring pump operable with said oil suction tube to define means for rapidly priming and repriming during brief interruptions in flow of oil from said oil sump, said liquid ring pump having an inlet port in communication with said oil sump, an outlet port in communication with said compressor, and a gas vent port in communication with said oil sump, said liquid ring pump including a generally cylindrical pump housing and an impeller assembly mounted for relative eccentric rotational movement within said pump housing.

12. The oil supply system of claim 11 wherein said inlet port and said gas vent port are radially inwardly of said pump housing and said outlet port is in said pump housing radially outwardly of said inlet port and said gas vent port, said inlet port and said gas vent port each comprising circumferentially spaced generally kidney-shaped openings in an end wall of said pump housing and said outlet port comprising an opening in a side wall of said pump housing, said impeller assembly including a central cylindrical hub having a plurality of impeller blades projecting radially therefrom.

13. The oil supply system of claim 12 wherein said central hub is mounted eccentrically within said pump housing to create a liquid ring surface having a radius encompassing said inlet port and said gas vent port, said central hub being dimensioned so as to fully expose said inlet port and said gas vent port within said pump housing.

* * * * *